United States Patent [19]

Derks

[11] Patent Number: 5,059,856

[45] Date of Patent: Oct. 22, 1991

[54] OXIDE CATHODE

[75] Inventor: Petrus J. A. M. Derks, Eindhoven, Netherlands

[73] Assignee: U.S. Philips Corp., New York, N.Y.

[21] Appl. No.: 439,994

[22] Filed: Nov. 21, 1989

[30] Foreign Application Priority Data

Dec. 13, 1988 [NL] Netherlands ..... 8803047

[51] Int. Cl.[5] ..... H01J 19/06

[52] U.S. Cl. ..... 313/346 R; 313/346 DC

[58] Field of Search ..... 313/346 R, 346 DC

[56] References Cited

U.S. PATENT DOCUMENTS

| | | | |
|---|---|---|---|
| 4,273,683 | 6/1981 | Kawamura | 313/346 DC X |
| 4,291,252 | 9/1981 | Aida et al. | 313/346 R |
| 4,369,392 | 1/1983 | Hotta et al. | 313/346 DC X |
| 4,924,137 | 5/1990 | Watanabe et al. | 313/346 R X |

*Primary Examiner*—Sandra L. O'Shea

*Attorney, Agent, or Firm*—Ernestine C. Bartlett

[57] ABSTRACT

The lifetime of oxide cathodes comprising, for example BaO and SrO as an emissive material, is improved by adding hafnium oxide or zirconium oxide.

6 Claims, 1 Drawing Sheet

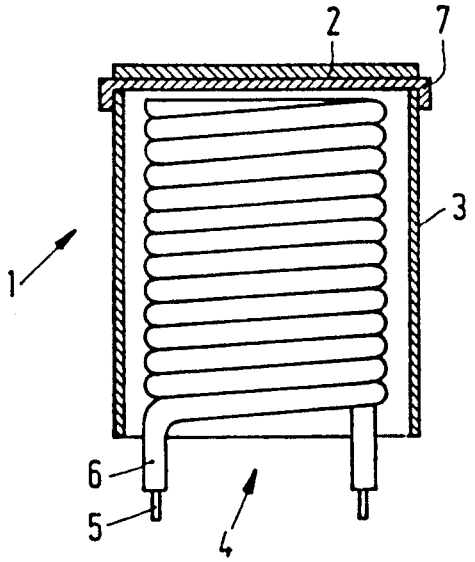
2
7
3
1
6
5
4

OXIDE CATHODE

BACKGROUND OF THE INVENTION

The invention relates to a cathode having a supporting body substantially consisting of nickel and being coated with a layer of electron-emissive material comprising alkaline earth metal oxides and barium.

Such cathodes are generally known and are described, for example in "Advances in Electronics and Electron Physics, 25, 211-275 (1968). The emission of such cathodes is dependent on releasing barium from the alkaline earth metal oxide barium oxide the alkaline earth metal oxide. In addition to the barium oxide, the electron-emissive material usually comprises strontium oxide and sometimes calcium oxide.

In practice the actual emission is substantially from by small regions (so-called "sites") spread over the electron-emissive material and having the lowest effective work function for electrons. regions having a slightly higher work function will hardly contribute to the electron current generated by the cathode.

OBJECT AND SUMMARY OF THE INVENTION

For a high effective electron emission it is therefore favourable if the number of sites with the lowest possible work function is as large as possible.

A cathode according to the invention is characterized in that the electron-emissive material comprises 0.1-10% by weight of hafnium oxide and/or zirconium oxide;

In a preferred embodiment the electron-emissive material comprises 0.2-5% by weight of hafnium oxide or zirconium oxide.

During experiments it was found that the lifetime of a cathode of the type described in the opening paragraph could be increased considerably by adding those oxides, and hafnium oxide in particular.

BRIEF DESCRIPTION OF THE DRAWING

The invention will now be described in greater detail with reference to an embodiment and the drawing which is a diagrammatic cross-section of a cathode according to the invention.

DESCRIPTION OF THE PREFERRED EMBODIMENTS

In this embodiment the cathode 1 comprises a cylindrical cathode shaft 3 having a cap 7. The cap 7 consists substantially of nickel and may comprise reducing means such as, for example silicon, magnesium, manganese aluminium and tungsten. The cathode shaft 3 accommodates a helical filament 4 which consists of a helically wound metal core 5 and an electrically insulating aluminium oxide layer 6.

An approximately 70 μm thick layer of emissive material 2 is provided on the cap 7, for example by spraying or by the method described in U.S. Pat. No. 4,197,152. The layer 2 comprises, for example a mixture of barium oxide and strontium oxide obtained by decomposing barium strontium carbonate; or a mixture of barium oxide, strontium oxide and calcium oxide.

According to examples of the invention the layer 2 also comprises approximately 2.5% by weight of hafnium oxide or approximately 1.5% by weight of zirconium oxide (calculated as a percentage of the quantity of barium strontium carbonate) which, in the case of spraying, may be added in the form of a powder to the spraying suspension. This yields a cathode having improved emission properties, notably with regard to the lifetime.

In lifetime tests it was found that at an unchanged filament voltage the addition of the said hafnium and zirconium oxides led to a variation in emission properties which was considerably less than in the conventional cathodes. Therefore, such cathodes can have a longer lifetime than a conventional cathode at an equal or even higher load.

The lifetime tests were performed as follows: The emission properties of cathodes with and without the said additions of zirconium and hafnium oxides to the layer of the emissive material were determined before and after 1000 operating hours at a filament voltage of 7 Volts, which is comparable to approximately 5000 real operating hours.

The emission measurements were performed at a filament voltage of 7 V, more specifically after 30 seconds of current at a cathode load of 2.2 $A/cm^2$ (so-called $\Delta i_k$ measurement). This yielded the following results:

| Type of addition to the emissive layer | Reduction of the emission ($\Delta\Delta i_k$) | (%) |
|---|---|---|
| none (reference) | 30 | |
| 2.5% by weight of $HfO_2$ | 4.4 | |
| 1.5% by weight of $ZrO_2$ | 9.5 | |

Consequently, the additions used yielded cathodes whose long-term emission behaviour had improved by a factor of 3-7. A further improvement, obtained by slightly modifying the various percentages, is not excluded.

Also emissive layers provided with both hafnium oxide and zirconium oxide are possible.

I claim:

1. In an electron beam tube provided with a cathode comprising a supporting body having an external surface, the supporting body comprising substantially nickel optionally containing reducing means and being coated on an external surface with a layer of electron-emissive material, the improvement wherein said emissive material consists essentially of (1) an alkaline earth metal oxide selected from barium oxide and mixtures of barium oxide with at least one oxide selected from the group of strontium oxide and calcium oxide and (2) from 0.1 to 10% by weight of an additive selected from the group of hafnium oxide, zirconium oxide and mixtures thereof.

2. A cathode as claimed in claim 1 wherein said electron-emissive material contains 0.2 to 5% by weight of said additive.

3. A cathode as claimed in claim 1 wherein the supporting body comprises reducing means.

4. A cathode as claimed in claim 2 wherein said additive is hafnium oxide.

5. A cathode as claimed in claim 2 wherein said additive is zirconium oxide.

6. An electron beam tube provided with a cathode comprising a supporting body having an external surface and consisting substantially of nickel containing reducing means, said body being coated with a layer of electron-emissive material consisting essentially of (1) an alkaline earth metal oxide selected from barium oxide and mixtures of barium oxide with at least one oxide selected from the group of strontium oxide and calcium oxide and (2) from 0.1 to 10% by weight of an additive selected from the group of hafnium oxide, zirconium oxide and mixtures thereof, the emission properties of said cathode being such that a 70 $\mu$m thick layer of emissive material is capable of attaining electron emission at a current load of 2.2 A/cm$^2$.

* * * * *